US008223114B2

(12) United States Patent
Eckhardt

(10) Patent No.: US 8,223,114 B2
(45) Date of Patent: Jul. 17, 2012

(54) METHOD FOR DISPLAYING A MOVING IMAGE ON A DISPLAY

(75) Inventor: Wolfgang Eckhardt, Weingarten (DE)

(73) Assignee: Eizo GmbH (DE)

( * ) Notice: Subject to any disclaimer, the term of this patent is extended or adjusted under 35 U.S.C. 154(b) by 881 days.

(21) Appl. No.: 12/048,438

(22) Filed: Mar. 14, 2008

(65) Prior Publication Data

US 2008/0224987 A1 Sep. 18, 2008

(30) Foreign Application Priority Data

Mar. 14, 2007 (DE) ..... 10 2007 012 391

(51) Int. Cl.
*G09G 3/36* (2006.01)
*G09G 5/10* (2006.01)

(52) U.S. Cl. ..... 345/102; 345/690; 345/87; 345/94

(58) Field of Classification Search ..... 345/102, 345/690, 204, 87, 94
See application file for complete search history.

(56) References Cited

U.S. PATENT DOCUMENTS 6,535,195 B1 * 3/2003 Nelson ..... 345/102
2008/0191999 A1 * 8/2008 Eckhardt ..... 345/102
2008/0259059 A1 * 10/2008 De Greef ..... 345/204

* cited by examiner

*Primary Examiner* — Bipin Shalwala
*Assistant Examiner* — Ilana Spar
(74) *Attorney, Agent, or Firm* — Ostrolenk Faber LLP

(57) ABSTRACT

A method for displaying a moving image on a display, such that all pixel lines of the display are addressed in each case during image periods for displaying image information, and a backlight for displaying the image information backlights the pixel lines. The display of moving images is enhanced by the fact that the pixel addresses remain unchanged during a first image period and a second image period, following the first image period, for displaying the same image information, and after the first image period, the backlight backlights the pixel lines following a waiting period.

4 Claims, 3 Drawing Sheets

METHOD FOR DISPLAYING A MOVING IMAGE ON A DISPLAY

This application claims priority under 35 U.S.C. §119(a) to German Patent Application No. 10 2007 012 391.6, filed on Mar. 14, 2007, the entire contents of which are hereby incorporated by reference.

BACKGROUND OF THE INVENTION

1. Field of the Invention

The invention relates to a method for displaying a moving image on a display, wherein all pixel lines of the display are addressed in each case during image periods for displaying image information, and a backlight for displaying the image information backlights the pixel lines.

2. Description of the Related Art

A backlight which generates light by means of cold cathode fluorescent lamps (CCFL) situated in rows is typically used for backlighting an LCD screen. The light radiates in all directions in the display, and a reflector is provided which reflects the back-radiated light in the direction of the LCD screen. Such a display may be used, in particular, in the medical field, in which a high contrast in image displays is desirable for the purpose of diagnosis. In addition, for this application, a low level of motion blurring of a moving image on an LCD screen of the display is desirable.

LCD screens belong to the so-called hold-type displays, whose image content is retained for the duration of one frame (one image period). Because of the reaction time of approximately 8 ms, for example, of the liquid crystals of the LCD screen, which represents the time for changing the brightness of an image pixel from 10% to 90%, an addressed image line does not immediately illuminate with the "correct" brightness. As a result, the edges of a displayed moving object appear blurred or indistinct to an observer for the duration of the display due to brightness integration. This interfering of blurring of movement is also intensified due to the fact that the actual motion of an object which may be represented on the display is beyond the limit of resolution by the human eye. The human eye typically detects a distance of approximately 0.15 mm, whereas an addressed scan line at an image refresh rate of 60 Hz is visible to the human eye for a duration of approximately 17 ms, during which time the moving object which is moving at a speed of 0.1 mm/s, for example, traverses a distance of 1.7 mm.

A blinking backlight is described in the publication titled "Rasante Zeiten, Techniken zur besseren Bewegtbilddarstellung auf Flachbildschirmen" ["Fast Times: Techniques for Improved Moving Image Displays on Flat Screens"], c't 2005, Issue 9. The blinking backlight temporarily switches off the background lighting before the end of a frame, thus reducing the light intensity to zero after illumination of an image and thereby decreasing the brightness integral and thus also decreasing blurring of the edges. A disadvantage is that so-called leading and trailing ghost images of the moving object are visible if the liquid crystals (pixels) are not yet aligned and still contain information from a previous image, or if the liquid crystals have realigned and therefore already contain information for a next image. A moving image display may be enhanced by use of a scanning backlight, in which lighting means, such as lamps, provided in rows are switched on and off during an image period on a line-by-line basis in synchronization with the image loading. A disadvantage is that a plurality of lighting means provided in rows is necessary.

German patent application 10 2007 009 014.7 proposes a method for displaying a moving image on an LCD screen, wherein all pixel lines are addressed during each image loading. The display of moving images is enhanced by the fact that after a waiting period, a backlight provides backlighting following each image loading. It is disadvantageous that the "electrical" as well as the "optical" frames are extended, which requires complex electronics.

SUMMARY OF THE INVENTION

The aspect of the present invention is to provide a method of the type mentioned at the outset, by means of which the display of a moving image is simplified.

The invention is directed to the concept of not backlighting an addressed image pixel during the state change of an addressed image pixel, i.e., during a change in brightness thereof, but, however, without extending the "electrical" frame. With regard to an LCD display, this means that during the alignment of the liquid crystals of the display, the liquid crystals are not backlit. Backlighting is not switched on until after all pixel lines, for example 1024 pixel lines each containing 1280 pixels, are addressed during an image period, and after this image period, the liquid crystals are aligned following a waiting period. During a subsequent image period, the addresses are not altered; i.e., the same image information is "rewritten," meaning that the liquid crystals do not need to be realigned. The fact that during the waiting period, which is part of the subsequent image period, the pixel lines are readdressed, but are not backlit by the backlight until after this waiting period, means that only the "optical" frame is altered, whereas the "electrical" frame remains unaltered. The display of a moving object appears as a sharp image to an observer, a flickering image being avoided by a suitable choice of a very high refresh rate above 120 Hz.

It is advantageous that no complicated LED backlight having a plurality of light-emitting diodes provided in rows and a complex electronic control system is required for the backlighting. A single lighting means, for example in the form of a lamp, is sufficient for backlighting the pixel lines.

In one non-limiting embodiment of the invention, the waiting period essentially corresponds to the time for altering the state of a pixel after it is addressed. This ensures that in every case, the backlight remains switched off during the "movement" of the image pixels, i.e., during the alignment of the liquid crystals, which causes a change in brightness.

According to a further non-limiting embodiment of the invention, the backlight backlights the pixel lines until the end of the second image period, thus allowing the luminance of the light generated by the backlight to be reduced.

BRIEF DESCRIPTION OF THE DRAWINGS

The invention and an exemplary embodiment of the present invention are now described with reference to the drawings.

DETAILED DESCRIPTION OF EXEMPLARY EMBODIMENTS OF THE INVENTION

Figure 2:
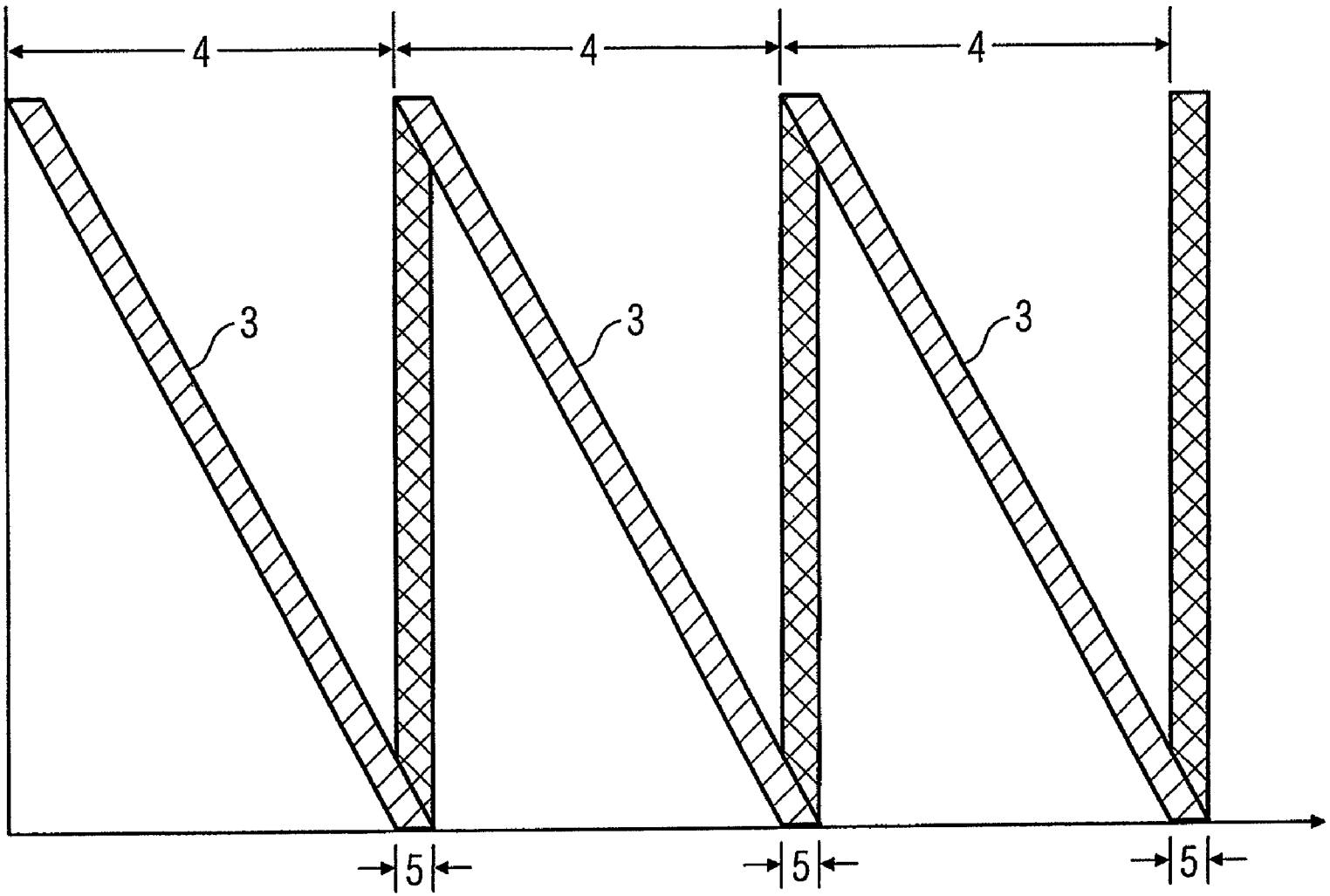
Figure 3:
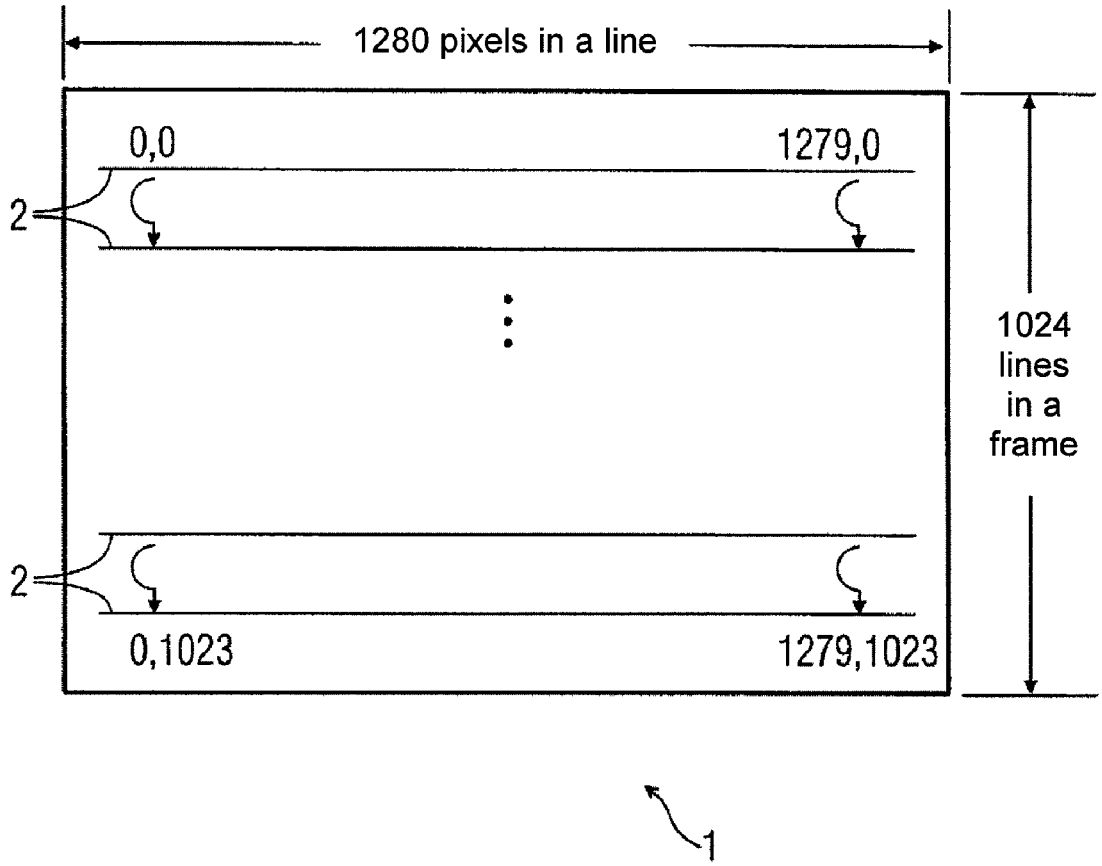
FIG. 3 shows an LCD image loading.

Reference is first made to FIG. 3, which illustrates an image loading or formation on a display 1 of an LCD screen during an image period (frame) having a frequency of 120 Hz. It is assumed that during the image period, all 1024 lines 2, each comprising 1280 pixels (liquid crystal cells), are addressed, whereby corresponding voltages are applied on a line-by-line basis to the liquid crystal cells. The liquid crystal cells align according to their reaction time, and by means of backlighting of the liquid crystal cells by a backlight, the image information on a display for the LCD screen is visible to an observer. The reaction time of the liquid crystal cells, during which the liquid crystals align and which represents the time for changing the brightness of an image pixel from approximately 10% to approximately 90%, is 4 ms, for example. Following this image period, during a subsequent further image period, an additional image is loaded, which in FIG. 2 is illustrated in each case in the form of continuous image bars 3 within a respective image period 4 of 8.3 ms (corresponding to 120 Hz). The width of the particular continuous image bar 3 indicates the time period for alignment of the liquid crystals after they are addressed or actuated. Due to the fact that during the flash, i.e., during the backlighting of the pixel lines by the backlight in time intervals 5, liquid crystals are not yet completely aligned, or liquid crystals are already realigned on account of new image information from the subsequent image period, motion blurring in the form of post- and pre-images is produced which is objectionable to an observer of the display 1.

To avoid backlighting during the alignment of the liquid crystals, after each image period, the pixel lines are not backlit until after a waiting period which is part of an image period subsequent to the image period in question. During these subsequent image periods for displaying the same image information as for the preceding image periods, the pixel addresses remain unchanged.

Figure 1:
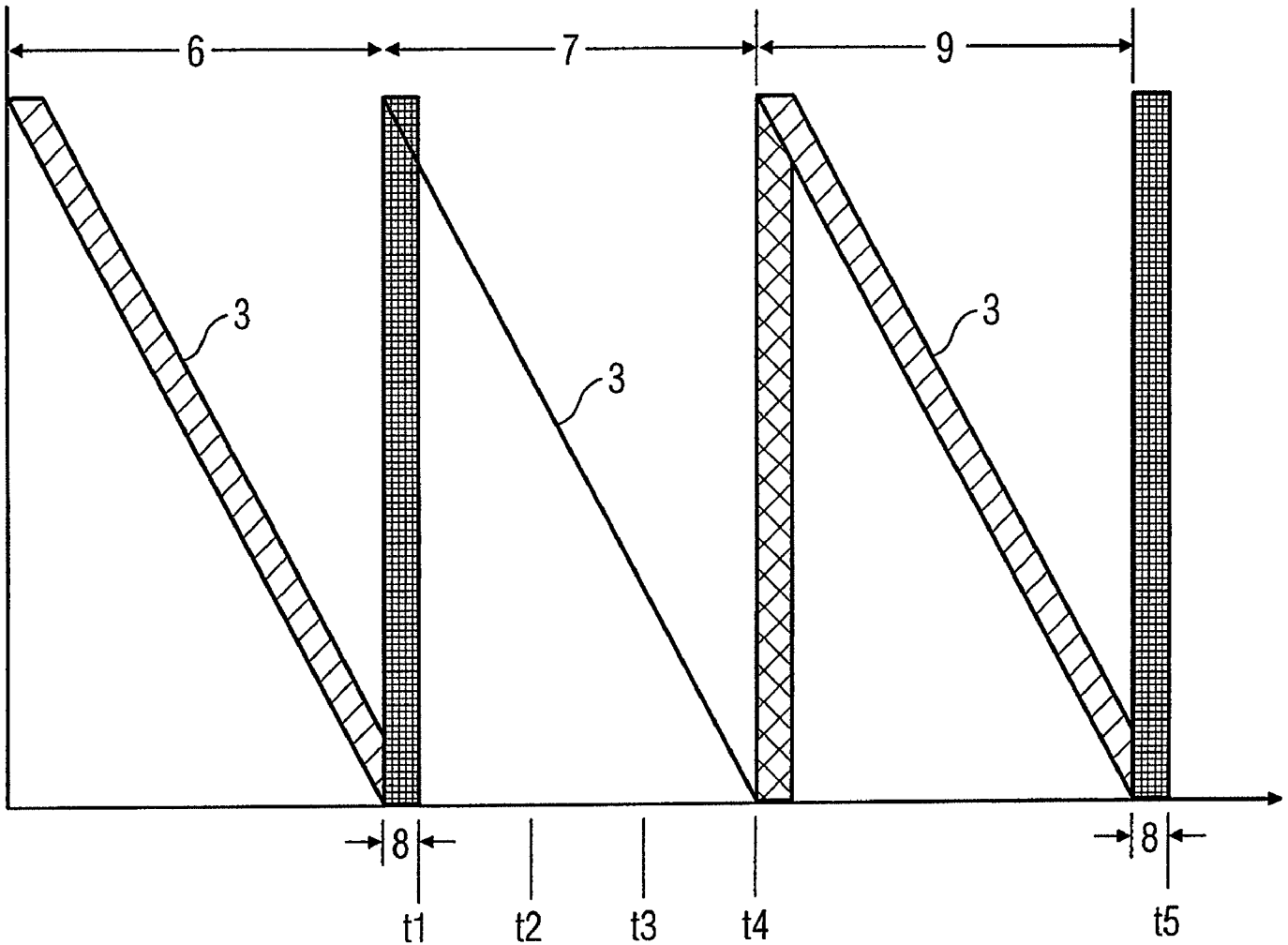
FIGS. 1 and 2 show image period-time diagrams.

In this regard, reference is made to FIG. 1, which illustrates an image period-time diagram. The image loading or formation in this case likewise occurs during an image period corresponding to image period 4 (period duration 8.3 ms) according to FIG. 2. The pixel addresses for displaying the same image information remain unchanged during a first image period 6 and a second image period 7 following this first image period, which means that the image content during these image periods 6, 7 is identical. In other words, the "frame" is "written in" twice, whereby the writing of the same "frame" causes no change in the state of the liquid crystals which are already aligned.

To prevent liquid crystals that are not yet aligned from being backlit by the backlight during a time interval corresponding to a waiting period 8, the backlight remains unlit during this waiting period 8, and the backlight does not backlight the pixel lines after this first image period 6 until this waiting period 8 has elapsed during the subsequent second image period 7. The waiting period 8 is part of the second image period 7 and essentially corresponds to the time for changing the state of a pixel after it has been addressed, i.e., the reaction time, which represents the time for changing the brightness of an image pixel from approximately 10% to approximately 90%.

Following this waiting period 8, the backlight is switched on, as the result of which the image information is visible to an observer of the display, and the backlight remains switched on until the end of the second image period 7 at a fourth time t4, thus allowing the luminance of the light generated by the backlight to be reduced. Of course, the backlight does not have to be switched on as late as the end of the second image period 7; the backlighting may also be switched off at a third time t3. However, it must be ensured that the backlight is switched off no later than the end of the second image period 7 at the fourth time t4 and remains switched off until a fifth time t5. This time t5 is already in an image period following the image period 9. In addition, the backlight need not be switched on exactly at the end of the waiting period 8 at a first time t1; this merely represents the earliest start of the backlighting. It is also possible for the backlighting to be switched on only after this waiting period 8 elapses during the second image period 7 at a second time t2.

To ensure that an image represented on the display and visible to an observer is free of flickering, a suitably high refresh rate above 120 Hz must be selected. LCD screens having such refresh rates will be commercially available in the future.

While the present invention has been particularly shown and described with reference to exemplary, non-limiting embodiments thereof, it will be understood by those of ordinary skill in the art that various changes in form and details may be made therein without departing from the spirit and scope of the present invention as defined by the following claims.

What is claimed is:

1. A method for displaying a moving image on a hold-type display, the image content of the moving image is retained for the duration of one image period, the method comprising:

addressing all pixel lines of the display during image periods for displaying image information, and backlighting the pixel lines by a backlight to display the image information, maintaining pixel addresses of the image information to remain unchanged during a first image period and a second image period following the first image period, for displaying the image information by rewriting the same image information from the first image period in the second image period, after the first image period, backlighting with the backlight the pixel lines following a waiting period, the waiting period included as a part of the second image period, and stopping the backlighting of the pixel lines before an end of the second image period.

2. The method according to claim 1, wherein the waiting period corresponds to a period for altering a state of a pixel after the pixel is addressed.

3. The method accordingly to claim 1, wherein after the waiting period, the backlight backlights the pixel lines during the second image period beginning at a first time or a second time up to a third time or an end of the second image period at a fourth time.

4. The method of claim 1, further comprising not backlighting the pixel lines during the waiting period.

* * * * *